United States Patent [19]

Collipp

[11] Patent Number: 4,585,373

[45] Date of Patent: Apr. 29, 1986

[54] PITCH PERIOD REDUCTION APPARATUS FOR TENSION LEG PLATFORMS

[75] Inventor: Bruce G. Collipp, Houston, Tex.

[73] Assignee: Shell Oil Company, Houston, Tex.

[21] Appl. No.: 716,318

[22] Filed: Mar. 27, 1985

[51] Int. Cl.[4] ..... E02B 17/00; B63B 35/44

[52] U.S. Cl. ..... 405/224; 114/265

[58] Field of Search ..... 405/195, 203, 209, 211, 405/224, 227; 114/264, 265

[56] References Cited

U.S. PATENT DOCUMENTS 3,285,213 11/1966 Whittle ..... 114/265 X
3,739,737 6/1973 Baier ..... 114/265
3,996,755 12/1976 Kalinowski ..... 405/224 X
4,423,983 1/1984 Dadiras et al. ..... 405/195
4,540,314 9/1985 Falkner ..... 405/227

*Primary Examiner*—David H. Corbin

[57] ABSTRACT

A tension leg platform is provided with exterior buoyant columns located outside the normal tension leg platform structure. The exterior columns decrease the pitch period of the tension leg platform away from the point of concentration of the largest wave spectrum energy encountered at a particular marine location. Modification of the pitch period of the tension leg platform in this manner reduces the cyclic fatigue stresses in the tension legs of the platform, and thereby increases the useful life of the platform structure.

11 Claims, 4 Drawing Figures

FIG. 2
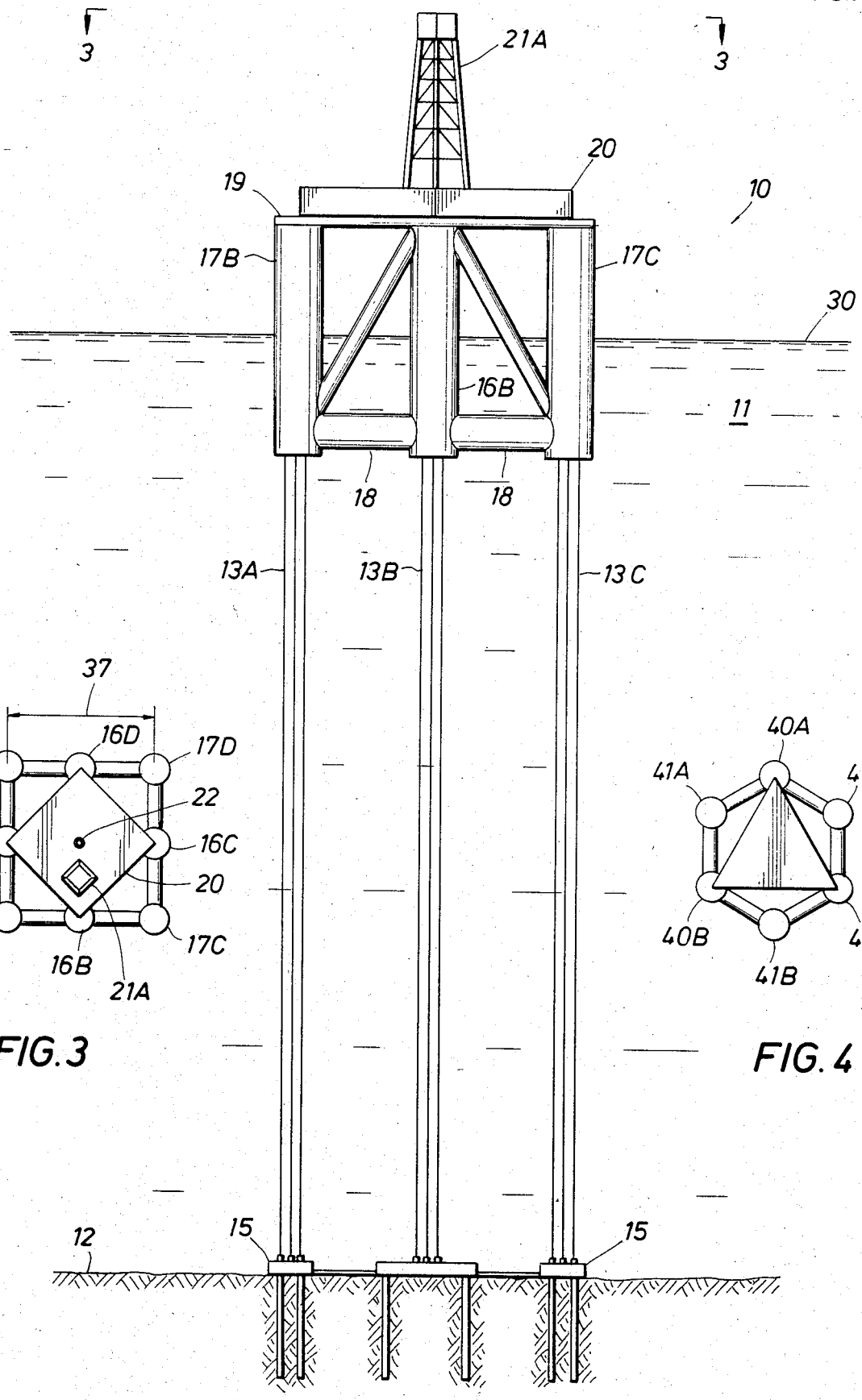
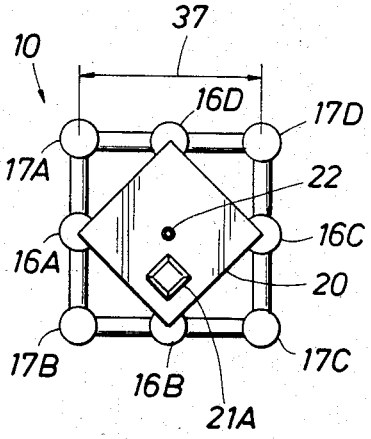
FIG. 3
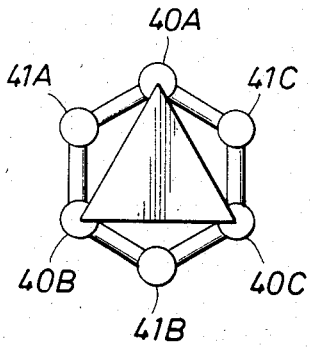
FIG. 4

PITCH PERIOD REDUCTION APPARATUS FOR TENSION LEG PLATFORMS

BACKGROUND OF THE INVENTION

1. Field of the Invention

This invention relates to anchored offshore platforms of the type used in oil and gas drilling and production and more particularly to an apparatus that forms an additional buoyant portion of a tension leg platform, located so as to reduce the pitch period of the platform. Decreasing the pitch period of the platform generally increases the fatigue life of the tension legs, and/or reduces the number and size of the tension legs.

2. Background of the Invention

In deep water, for example 800 feet or more, the installation of bottom mounted steel or concrete structures for oil well drilling and production operations becomes quite expensive due to the high cost of fabrication and installation of such large structures. A more economical solution to the problem of providing a suitable semi-permanent site for drilling and producing operations in deep water is the use of a floating structure which is moored to fixed sea floor anchor points by means of vertical tension legs. Such a structure is known as a tension leg platform.

A tension leg platform is a complex system which is difficult to design by the usual "cut and try" approach. The various elements in the tension leg platform system are strongly coupled and interact with each other in a complicated manner.

As can be imagined, design of a tension leg platform must be done with full recognition of a number of design constraints. The most important constraints to be considered include maximum stress in the legs, fatigue life of the legs (as affected by cyclic pitch and heave motions of the tension leg platform), minimum leg tension at the bottom, and maximum platform offset. Satisfaction of these constraints requires analysis of the response of the tension leg platform to winds, waves, and current.

Estimation of the fatigue life or required strength in the legs involves consideration of the so-called "pitch period criterion" which is a relation between the maximum recommended resonant or natural pitch period of the tension leg platform versus the platform's installed water depth. The pitch period criterion is really a derived criterion based upon consideration of the fatigue life of the tension legs. It represents an attempt to alter the tension leg platform motion response characteristics with respect to prevailing wave energy such that a resonably long fatigue life of the tension legs can be assured. In general, the pitch period for a tension leg platform should be designed to be as low as possible or at least with a period that is not near the period of any significant energy in the sea spectra. For example, calculations indicate that decreasing the pitch period of a tension leg platform from 4.1 to 4.0 seconds may increase the fatigue life of the tension legs by approximately 33%.

Accordingly, it is desirable to present a method of reducing the pitch period response of a particular tension leg platform in order to construct or modify the design of the platform such that the pitch period response is reduced below the maximum wave spectrum frequency response areas. It is also desirable to present an apparatus that allows the pitch period response of existing tension leg platform designs to be modified sufficiently to maximize the life of the tension leg platform structure.

SUMMARY OF THE INVENTION

In a preferred embodiment of the present invention exterior buoyant member means such as vertical buoyant columns are added to an existing tension leg platform design in order to decrease the pitch period response of the tension leg platform. The spacing of these exterior buoyant member means away from the center of gravity of the platform and its associated existing deck mass may be made in light of the following considerations:

The natural pitch period of the entire tension leg platform is controlled by the natural pitch period of the platform and the relative stiffness of the tension legs. By decreasing the natural pitch period of the total system by adding columns external to the columns through which the tension legs extend the hydrodynamic properties of the upper hull reduce the stiffness that has to be incorporated into the tension legs, which results in the use of less steel required for construction of the tension legs. Mathematically a general equation for natural pitch period can be described by:

$$T_N \approx T_p + T_L$$

Where:

$T_N$=natural period of the total system $T_p$=natural period of the upper hull and columns $T_L$=natural period of the tension legs $T_P$ is inversely proportional to the column spacing. A larger exterior column spacing dimension, "S", will lead toward the desirable effect of reducing the natural period of the total system.

$T_L$ is proportional to the length of the tension leg which is approximately equal to the water depth, and is inversely proportional to the number and cross-sectional area of the tension legs. In other words $T_L$ increases undesirably as the total cross-sectional area of the tethers is decreased in an attempt to reduce cost. As can be imagined additions to the number and cross-sectional area of the tension legs increases the cost of the tension leg platform structure.

More specifically for a tension leg platform with eight columns of the configuration shown in FIG. 1 of the drawings the following equation for natural period is a good approximation. Obviously other configurations such as a tension leg platform with three interior columns from which the tension legs extend surrounded by three other exterior buoyant columns can be envisioned, as shown in FIG. 4 of the drawings. Other configurations can be imagined and the number of interior columns does not necessarily have to be the same as the number of exterior buoyant columns.

For an eight column tension leg platform the following equation provides a good approximation of the natural period and more importantly describes the relationship of the various variables:

$$T_N = 4\pi \cdot \left[ \frac{L}{AE} \cdot \left[ \frac{W}{32.2} 2000 \right] \cdot \left[ \left[ \frac{K_{yp}}{S} \right]^2 + \right.\right.$$

-continued $$r \cdot \left[ \frac{8}{3} r_s^2 + \frac{4}{3} a \right] - 16 \frac{r^2 r_s^2}{1 + 8r} \Bigg] \Bigg]^{\frac{1}{2}}$$

Where:

L: Tether length (ft.)

A: Total tether cross-sectional area ($in^2$)

E: Young's modulus (psi)

W: Free floating displacement (ST)

$K_{yy}$: Gyradius (ft.)

S: Column spacing, center to center (ft.)

r: Ratio of single column displacement to free floating displacement (fraction)

$r_s$: Ratio of installed draft to column spacing (fraction)

a: Added mass coefficient (fraction)

In studying this equation, as mentioned earlier the pitch period $T_N$ can be seen to be primarily sensitive to: (1) tether cross-sectional area, (2) total system mass [or displacement], and (3) spacing between corner columns through which the tethers run. The pitch period $T_N$ is inversely proportional to the column spacing dimension "S." From the above equation, the solution to controlling pitch period for a given water depth becomes more evident. First the tension leg platform should be designed to keep the cross-sectional area "A" of the tethers as small as possible in order to minimize structural weight, hence installed costs. This acts, unfortunately, to raise the pitch period. The pitch period may then be reduced a desired amount by increasing the column spacing "S."

Study of the above equation further indicates secondly that pitch period is directly increased by the increase of gyradius "$K_{yy}$" to which the deck mass is a strong contributor. Faced with the need to reduce pitch period, the deck mass should be maintained as compact as possible, whereas the hull structure column spacing dimension "S" should conversely be as large as possible. The platform designer therefore addresses a platform geometry dilemma where the desired deck size and the supporting column spacing may be quite different in order to satisfy motion response requirements.

The deck mass components should be clustered as close as possible to the center of gravity of the tension leg platform, but the buoyant support columns for the deck mass should be spaced as far apart as possible. For an example of column spacing requirements, motion response calculations show that suitable pitch period criterion in 6000 ft. water depth would only be satisfied if the corner column spacing is increased beyond 300 ft.

To solve this design dilemma exterior buoyant columns, the object of the present invention, may be attached outboard of interior columns that support the deck mass. The spacing of the exterior columns may be selected relatively independent of the concentrated dimensions of the deck mass. In this manner the deck mass may be concentrated in order to minimize the radius of gyration "$K_{yy}$" and thereby the pitch period "$T_N$" of the platform, at the same time that the column spacing dimension "S" may be maximized, which also reduces the pitch period "$T_N$" of the tension leg platform.

An object of the present invention is to install outboard exterior buoyant member means about a tension leg platform to spread the effective column spacing dimension "S" outward from a centralized deck mass, to reduce the pitch period of the tension leg platform below the pitch period criterion limits given for a particular water depth.

A further object of the invention is to present a method of addition of exterior buoyant members to existing tension leg platform designs in order to increase the fatigue life of tension leg platforms, without alteration of the column spacing required to support the existing deck mass.

These and other features, objects and advantages of the present invention will become apparent from the following detailed description, wherein reference is made to the figures in the accompanying drawings.

BRIEF DESCRIPTION OF THE DRAWINGS

FIG. 2 is a side view of the tension leg platform.

FIG. 3 is a plan view taken along lines 3—3 of FIG. 2 showing the orientation of the exterior columns relative to the tension leg platform structure.

FIG. 4 is a plan view showing the orientation of three exterior columns relative to a three interior column tension leg platform structure.

DETAILED DESCRIPTION OF THE PREFERRED EMBODIMENT

Figure 1:
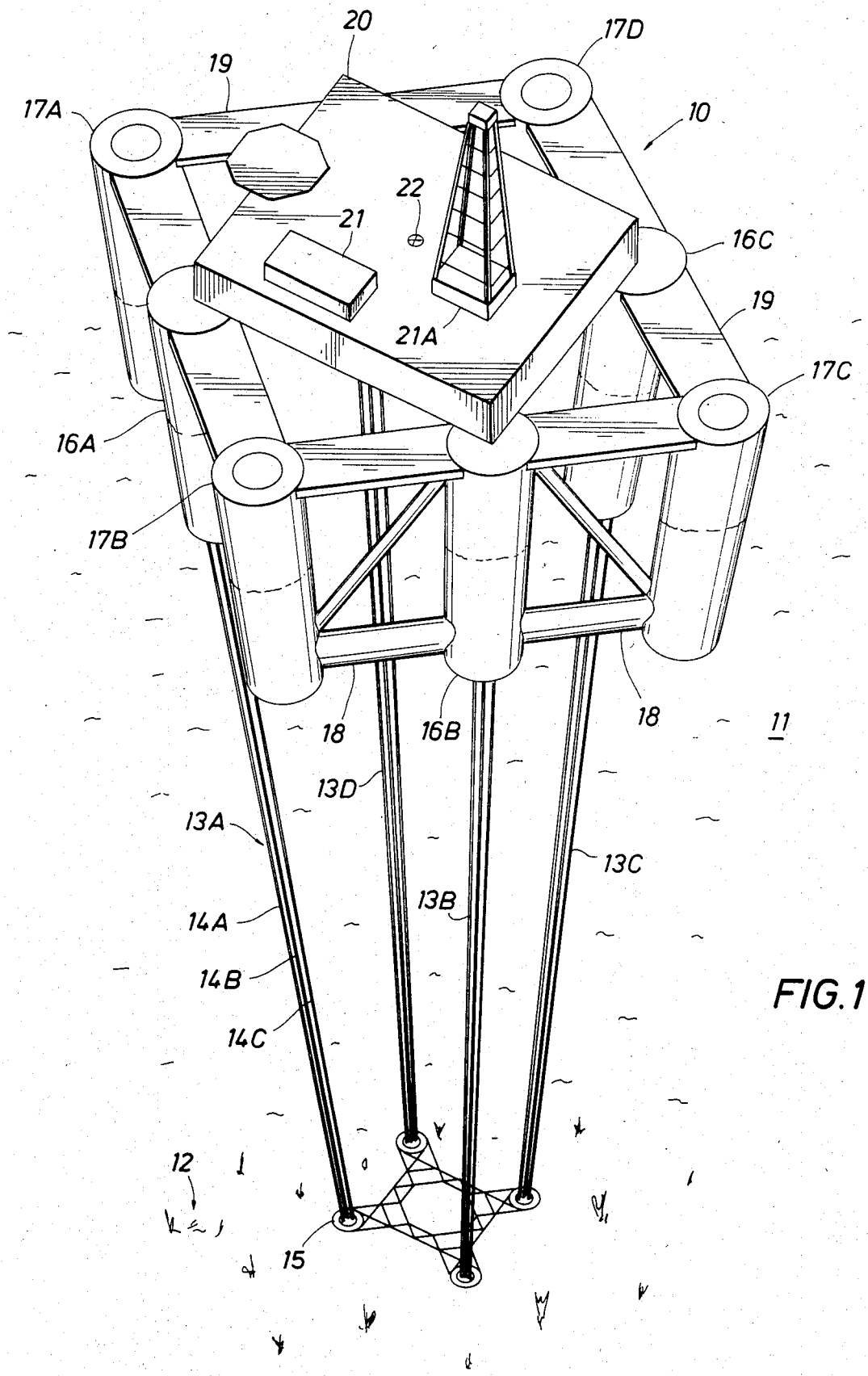
FIG. 1 is an isometric view showing a tension leg platform anchored by means of tension legs to an anchor means carried upon the bottom of a body of water.

Referring now to FIG. 1, a tension leg platform 10 is shown floating in a body of water 11 having a marine bottom 12. A plurality of tension legs 13A–D, typically formed as is the case of tension leg 13A from tubular leg elements 14A–C, well known to the art operatively connect the tension leg platform 10 to anchor means 15 which are carried by the marine bottom 12. Buoyant interior columns 16A–C which in a preferred embodiment may form a portion of interior buoyant member means, are shown operatively connected to exterior columns 17A–D by suitable horizontal structural members which may be non-buoyant, or buoyant, or of adjustable buoyant design of any desired form well known to the art. For example, a submerged pontoon 18 section may connect the lower ends of the exterior columns 17A–D to the lower ends of the interior columns 16A–C. Structural elements 19, such as steel beams well known to the art, connect the upper portions of buoyant exterior columns 17A–D to the upper portion of the buoyant interior columns 16A–C which would form the main buoyant members of the platform. In like manner, interior colum 16D, shown more clearly in FIG. 3, may be connected at the upper and lower portions to exterior columns 17A and 17B. Exterior columns 17A–D in a preferred embodiment may form a portion of exterior buoyant member means, and may be constructed so as to form vertical buoyant columns adapted to be partially immersed in the body of water 11. In a preferred embodiment the interior columns 16A–D would form the main buoyancy support members, whereas the exterior columns 17A–D would form the auxiliary buoyancy support members.

A deck mass 20 is shown operatively connected to interior columns 16A–C, and 16D as shown in FIG. 3. The deck mass 20 will typically carry drilling and/or production equipment 21, 21A such as a derrick and quarters facility well-known to the art. The deck mass 20 will also, due to the location of such drilling and production equipment 21 and 21A , acting in combination with the buoyancy supplied by the buoyant interior and exterior columns 16, 17, have a particular center of gravity 22 defined at some central location to the entire tension leg platform 10 structure. The deck mass 20 in a preferred embodiment will have sufficient overall length and width dimensions to supply enough area to support the drilling and production equipment 21 and 21A.

Referring now to FIG. 2, the tension leg platform 10 is shown floating upon the surface 30 of the body of water 11. Elements 11 through 13 and 15 through 21 mentioned earlier are shown for visual reference from a side view perspective.

Referring now to FIG. 3 the tension leg platform 10 is shown in a plan view taken along lines 3—3 of FIG. 2. Deck mass 20 is shown operatively connected to interior columns 16. Exterior columns 17A–D are shown also operatively connected to interior columns 16A–D, respectively.

Interior columns 16A–D not only support the weight of the deck mass 20 but are also engaged in tension to anchor means 15 carried by the marine bottom 12. The interior columns 16A–D can be seen to form the corners of a horizontal interior polygon about the center of gravity 22 of the tension leg platform 10. It is recognized that whereas in FIG. 3 the interior polygon forms a rectangle, many other geometric configurations of the interior column 16A–D may be used to properly support the deck mass 20 in a stable manner. The interior columns 16A–D are shown arranged in a symmetric fashion about the approximate location of the center of gravity 22. It is recognized that at times the columns 16A–D may be arranged in a non-symmetrical manner in order to properly compensate for concentration variations of the deck mass 20. It is recognized that whereas four interior columns 16A–D are shown, more or less than 4 columns may also be used to properly support the deck mass 20.

In a preferred embodiment exterior buoyant member means such as the exterior columns 17A–D may be operatively connected to the interior buoyant member means. The exterior columns 17A–D may form the corners of a horizontal exterior polygon such that at least a portion of the sides of the exterior polygon will be located outside the sides of the interior polygon mentioned earlier, when both polygons are viewed from a direction perpendicular to both the interior and exterior horizontal polygons. Whereas four exterior columns 17A–D are shown, it should be well recognized that more or less than four columns 17A–D may be used to effectively decrease the pitch period of the tension leg platform 10.

The distance between each respective adjacent exterior column 17A–D may be designated by the column space dimension 37 shown in FIG. 3. In the case of a symmetric arrangement of exterior columns 17A–D about interior columns 16A–D the column space dimension 37 may be equal when taken between adjacent exterior columns 17A–D.

The horizontal exterior polygon may also form a rectangle or any other geometric shape in order to insure that the center of gravity 22 of the tension leg platform 10 is maintained within acceptable stability limits. Each exterior column such as 17A may be connected to the two adjacent interior columns such as 16A and 16B. Exterior column 17A for example may also be spaced equidistant from the interior columns 16A and 16D.

Due to the outward placement of the exterior columns 17A–D, away from the center of gravity 22 of the tension leg platform 10, it may be seen that the area bounded by the sides of the exterior polygon may substantially exceed the area bounded by the sides of the interior polygon. More specifically, the area bounded by the exterior polygon may be at least 1½ times the area bounded by the interior polygon dependent upon the overall column spacing dimension 37 as compared to the periphery of the deck mass 20 and the resultant location of the interior columns 16.

In designing the tension leg platform 10 it should be noted that the deck mass 20 must be kept centrally located in order to minimize the radius of gyration "$K_{yy}$" of the structure. Once a particular deck mass 20 configuration is selected, then the exterior column 17 space dimension 37 may be calculated. For example, using the equation given earlier, in a water depth of 6,000 feet and with a tether area of 4,000 sq. in., in the deck mass approximates 15,000 short tons arranged on a 240′ square area a column spacing of approximately 340 ft. would be maintained by the exterior columns 17 in order to maintain the pitch period less than 3.5 seconds, under all anticipated values of pretension encountered in the tensioning of the tension legs 13A–D.

It is understood that to reduce the total fabrication difficulty of the tension leg platform 10, the exterior columns 17 should most probably be fitted and fixedly connected to the tension leg platform 10 at the time that the platform 10 is fabricated. It is recognized, however, that an exterior column buoyancy system may also be added to an existing tension leg platform 10 after the platform 10 has been installed at a particular marine location. In this manner, the pitch period of the platform 10 may be decreased once the established pitch period of the platform 10 has been determined at an actual location.

As shown in FIG. 4 in an alternative embodiment of the present invention three interior columns 40A,B,C may be arranged symmetrically inside three exterior columns 41A,B,C. Many other variations and modifications may be made in the apparatus and techniques herein before described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. An apparatus for use in decreasing the pitch period of a tension leg platform, said platform having a center of gravity and floating in a body of water having a marine bottom, said platform said platoform having interior buoyant member means, the upper portion of said interior buoyant member means connected to a deck mass, the lower portion of said interior buoyant member means operatively engaged in tension to anchor means secured to said marine bottom, said interior buoyant means arranged in a manner wherein they form the corners of a horizontal interior polygon about said center of gravity of said platform, said apparatus comprising;

exterior buoyant member means in the form of buoyant columns operatively connected to said interior buoyant member means, said exterior buoyant member means arranged in a manner wherein they form the corners of a horizontal exterior polygon, at least a portion of the sides of said exterior polygon located outside the sides of said interior polygon, when viewed from a direction perpendicular to said interior and exterior polygons.

2. The apparatus of claim 1 wherein said exterior buoyant member means forms a vertical buoyant column partially immersed in said body of water, said column having an upper portion operatively connected by structural elements to said interior buoyant member means, said column having a lower portion operatively connected by pontoons to said interior buoyant member means.

3. The apparatus of claim 2 wherein each of said exterior buoyant member means is operatively connected to two adjacent interior buoyant member means.

4. The apparatus of claim 1 wherein said horizontal exterior polygon forms a rectangle.

5. The apparatus of claim 1 wherein the number of interior buoyant member means equals the number of exterior buoyant member means.

6. The apparatus of claim 1 wherein each of said exterior buoyant member means is spaced equidistant from each adjacent interior buoyant member means.

7. The apparatus of claim 1 wherein the area bounded by the sides of the exterior polygon substantially exceeds the area bounded by the sides of the interior polygon.

8. The apparatus of claim 7 wherein the area bounded by the sides of the exterior polygon is at least one and one-half times the area bounded by the sides of the interior polygon.

9. An apparatus for use in decreasing the pitch period of a tension leg platform, said platform having a particular center of gravity when partially immersed in a body of water having a marine bottom and being floatable in said body of water, said platform having interior buoyant member means, the upper portion of said interior buoyant member means connectable to a deck mass, the lower portion of said interior buoyant member means operatively engageable in tension to anchor means secured to said marine bottom, said interior buoyant member means arrangeable in a manner wherein they form the corners of a horiztonal interior polygon about said center of gravity of said platform, said apparatus comprising:

exterior buoyant member means operatively connectable to said interior buoyant member means, said exterior buoyant member means arranged in a manner wherein they form the corners of a horizontal exterior polygon, at least a portion of the sides of said exterior polygon locatable outside the sides of said interior polygon, when viewed from a direction perpendicular to said interior and exterior polygons.

10. A method of decreasing the pitch period of a tension leg platform, said platform having a center of gravity and floatable in a body of water having a marine bottom, said platform having interior buoyant member means, the upper portion of said interior buoyant member means connected to a deck mass, the lower portion of said interior buoyant member means operatively engageable in tension to anchor means secured to said marine bottom, said interior buoyant member means arranged in a manner wherein they form the corners of a horizontal interior polygon about said center of gravity of said platform, said method comprising;

operatively connecting exterior buoyant member means in the form of buoyant columns to said interior buoyant member means, said exterior buoyant member means forming the corners of a horizontal exterior polygon, at least a portion of the sides of said exterior polygon located outside the sides of said interior polygon, when viewed in a direction perpendicular to said interior and exterior polygons.

11. The method of claim 10 wherein said exterior buoyant member means are operatively connected to said interior buoyant member means prior to floating said tension leg platform in said body of water.

* * * * *